US006020291A

United States Patent [19]

Lange et al.

[11] Patent Number: 6,020,291

[45] Date of Patent: Feb. 1, 2000

[54] BRANCHED SULFONATE CONTAINING COPOLYMERS AS MIST SUPPRESSANTS IN SOLUBLE OIL (WATER-BASED) METAL WORKING FLUIDS

[75] Inventors: Richard M. Lange, Euclid; Sanjay Kalhan, Willoughby Hills; Richard A. Denis, Auburn Township, all of Ohio

[73] Assignee: The Lubrizol Corporation, Wickliffe, Ohio

[21] Appl. No.: 08/975,622

[22] Filed: Nov. 21, 1997

[51] Int. Cl.[7] ..... C10M 173/00; C10M 159/12; C10M 151/04

[52] U.S. Cl. ..... 508/404; 508/387

[58] Field of Search ..... 508/404, 387

[56] References Cited

U.S. PATENT DOCUMENTS

| | | | |
|---|---|---|---|
| 3,833,502 | 9/1974 | Leary et al. | 252/49.5 |
| 4,034,001 | 7/1977 | Miller et al. | 508/404 |
| 4,293,427 | 10/1981 | Lucase et al. | 252/8.5 A |
| 4,404,111 | 9/1983 | Bi et al. | 252/8.55 D |
| 4,432,881 | 2/1984 | Evani | 252/8.5 A |
| 4,493,777 | 1/1985 | Snyder, Jr. et al. | 252/49.3 |
| 4,520,182 | 5/1985 | Turner et al. | 526/307.2 |
| 4,563,294 | 1/1986 | Geymayer et al. | 252/49.3 |
| 4,770,814 | 9/1988 | Rose et al. | 252/315.4 |
| 4,812,544 | 3/1989 | Sopko et al. | 526/73 |
| 4,880,565 | 11/1989 | Rose et al. | 252/355 |
| 5,021,526 | 6/1991 | Ball | 526/240 |
| 5,039,433 | 8/1991 | Sopko et al. | 252/8.551 |
| 5,089,578 | 2/1992 | Valint et al. | 526/240 |
| 5,134,118 | 7/1992 | Patel et al. | 507/121 |
| 5,294,651 | 3/1994 | Stephens | 524/3 |

FOREIGN PATENT DOCUMENTS

| | | | |
|---|---|---|---|
| 750 899 | 1/1997 | European Pat. Off. | A61K 7/00 |
| WO93/24601 | 12/1993 | WIPO . | |

OTHER PUBLICATIONS

Patil et al. "Sucrose Diacrylate," J. Polym Sci A: Polym. Chem 35: 2221–2229.

*Primary Examiner*—Jerry D. Johnson
*Attorney, Agent, or Firm*—David M. Shold

[57] ABSTRACT

Aqueous metal working fluids containing a mist suppressing branched copolymer are disclosed. The copolymer includes hydrophobic and hydrophilic monomers. Optionally, the metal working fluid may be an oil-in-water emulsion.

19 Claims, No Drawings

BRANCHED SULFONATE CONTAINING COPOLYMERS AS MIST SUPPRESSANTS IN SOLUBLE OIL (WATER-BASED) METAL WORKING FLUIDS

BACKGROUND OF THE INVENTION

This invention relates to aqueous metal working fluids comprising of water and a mist suppressing copolymer. Optionally, the fluid may be an oil-in-water emulsion. Such emulsions include oil and an emulsifier. In addition to the mist suppressing copolymer, metal cutting operations often involve a work piece which rotates at relatively high speed, and a cutting tool both of which are lubricated by a metal working fluid. Under these high shear conditions, the metal working fluid is frequently thrown from the surface of the metal in the form of droplets. Often the droplets are small enough to be classified as a mist. Misting, or the formation of a mist is considered undesirable, because it represents a loss of the cutting fluid, and the cutting fluid mist is considered a contaminant in the air around the cutting machine.

Polymers containing acrylamides are known to thicken aqueous materials.

U.S. Pat. No. 5,089,578 discloses novel hydrophobically associated terpolymers containing sulfonate functionality which are useful as aqueous fluid rheology or flow control modifiers. The water soluble monomers are acrylamide and a salt of an ethylenically unsaturated sulfonic acid and the water insoluble monomer is a higher alkyl acrylamide. The ethylenically unsaturated sulfonic acids include materials such as sodium 2-acrylamido-2 methylpropane sulfonate. The mole percentage of acrylamide is preferably 5 to 98, more preferably 10 to 90 mole percent, the mole percentage of the salt of the sulfonate containing monomer is preferably from 2 to 95, and the mole percentage of the hydrophobic monomer is preferably from 0.1 to 10.0, more preferably 0.2 to 5 mole percent.

Acrylic polymers are used to control misting in metal working applications.

U.S. Pat. No. 4,493,777 discloses substantially oil free aqueous industrial fluids possessing superior lubricating and wear preventing characteristics which are useful as hydraulic fluids and metal working compositions. The fluids of the invention comprised one (1) an aqueous liquid and (2) a water soluble synthetic addition copolymer of (a) an ethylenically unsaturated cross-linking monomer, (b) an ethylenically unsaturated water soluble monomer and (c) an ethylenically unsaturated water insoluble monomer. The water soluble monomers include acrylamido-2-methylpropane sulfonic acid. Water insoluble monomers include styrene compounds, vinyl esters and acrylate esters. The cross-linking monomers are polyvinyl compounds which are present in amounts sufficient to control the degree of swellability of said copolymerization product, while imparting mechanical reinforcement to said copolymerization product.

International Patent WO 93/24601 discloses clear water-soluble polymer compounds having mean molecular weight higher than 1 million and selected among the polyalkylene oxides, polyacrylamides, polymethacrylamides, and the copolymers of an acrylamide and/or methyl acrylamide with unsaturated organic carboxylic acids having three (3) to five (5) carbon atoms, which are used in water-miscible and water mixed cooling lubricants, to reduce mist formation.

Polymeric anti-misting additives reduce the misting of machine fluids at the source by stabilizing them against break-up during the extreme shear conditions which occur during metal working operations. High molecular weight poly(ethylene oxide) is commonly used in this application. A typical polymer is POLYOX® available from Union Carbide. Typically, these polymers have a molecular weight from 1 to 2 million. However, these polymers are susceptible to shear. Metal working application often involve high shear, and as a result, metal working fluids containing high molecular weight poly(ethylene oxide) often suffer in performance when subjected to shear. Such degradation results when high shear conditions cause high molecular weight poly(ethylene oxide) to break down and lose its ability to suppress mist formation. In such high shear applications, the polymer must be replenished frequently.

SUMMARY OF THE INVENTION

The present invention provides An aqueous metal working fluid comprising water and a mist suppressing copolymer formed by copolymerizing:

(A) at least one hydrophobic monomer selected from the group consisting of

A(I) alkyl substituted acrylamide compounds represented by the formula:

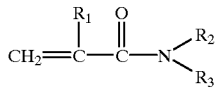

wherein $R_1$ is a hydrogen or a methyl group and $R_2$ and $R_3$ are independently hydrogen or hydrocarbyl groups, provided that the total number of carbon atoms in $R_2$ and $R_3$ combined is 2 to 36; and A(II) acrylate esters represented by the formula:

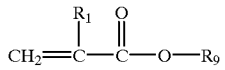

where $R_1$ is a hydrogen or a methyl group and $R_9$ is a hydrocarbyl group or an alkyl-terminated polyether group;

(B) at least one hydrophilic monomer selected from the group consisting of

B(I) sulfonic acids represented by the formula:

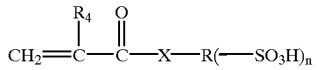

and salts thereof, wherein X is O or NY, where Y is hydrogen, a hydrocarbyl group of 1 to 18 carbon atoms or $—R(—SO_3H)_n$, $R_4$ is a hydrogen or a methyl group, each R is independently an aliphatic or aromatic hydrocarbylene group containing 2 to 18 carbon atoms, and each n is independently 1 or 2; and B(II) styrenic sulfonic acids and salts thereof; and (C) at least one ethylenically unsaturated branching monomer;

wherein the salts of component (B) are selected from the group consisting of alkali metal salts, alkaline earth metal salts, salts of the metals Sc, Ti, V, Cr, Mn, Fe, Co, Ni, Cu and Zn, and ammonium salts;

further provided that if A is A(I) then the ratio of moles of A to B is 95:5 to 25:75; and if A is A(II), then the ratio of moles of A to B is 90:10 to 25:75; and where the amount of branching monomer C is sufficient to provide reduced mist formation when said aqueous metal working fluid is subjected to metal-working conditions but not so much as to cause substantial crosslinking of the polymer.

DETAILED DESCRIPTION OF THE INVENTION

The term "hydrocarbyl" includes hydrocarbon, as well as substantially hydrocarbon, groups. Substantially hydrocarbon describes groups which contain non-hydrocarbon substituents which do not alter the predominantly hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-, aliphatic- and alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon substituent; those skilled in the art will be aware of such groups (e.g., halo (especially chloro and fluoro), hydroxy, alkoxy, mercapto, alkylmercapto, nitro, nitroso, sulfoxy, etc.); and (3) hetero substituents, that is, substituents which will, while having a predominantly hydrocarbon character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furyl, thienyl, imidazole, etc. In general, no more than about 2, preferably no more than one, non-hydrocarbon substituent will be present for every ten carbon atoms in the hydrocarbyl group. Typically, there will be no such non-hydrocarbon substituents in the hydrocarbyl group. In that case, the hydrocarbyl group is purely hydrocarbon.

Similarly, the term "hydrocarbylene" refers, by analogy to the term "alkylene," to a divalent material of a hydrocarbyl nature.

Copolymer

The anti-misting aqueous compositions contain a copolymer which is formed by the copolymerization of a water soluble monomer, often referred to as a hydrophilic monomer, and a water insoluble monomer, often referred to as a hydrophobic monomer, along with a branching monomer. The hydrophobic monomers are alkyl substituted acrylamides, alkyl substituted methacrylamides, acrylate esters and methacrylate esters, the hydrophilic monomers are sulfonate molecules containing a single ethylenic linkage. When the polymer contains alkyl substituted acrylamides and alkyl substituted methacrylamides as the hydrophobic monomer then the molar percentage of the hydrophobic monomer is preferably in the range of 25 to 95 percent based on the total of the hydrophobic and hydrophilic monomers, that is, without accounting for the branching monomer. In this case, the molar percentage of the hydrophilic monomer would be in the ratio of 5 to 75 molar percent. When the polymer contains alkyl substituted acrylates and alkyl substituted methacrylates as the hydrophobic monomer then the molar percentage of hydrophobic monomer, thus calculated, is preferably 25 to 90 percent and the molar percentage of the hydrophilic monomer would be 10 to 75 percent. In the polymerization reaction the ethylenic linkages polymerize and the resulting polymer consists of a polyethylene backbone with hydrophilic and hydrophobic side chains. Monomers, or amounts of monomers, which lead to cross-linking (as opposed to branching) of the polymer are not desirable in the present invention and are excluded.

Hydrophobic Monomers

The hydrophobic monomer can be an acrylamide or methacrylamide corresponding to the following formula:

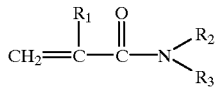

In this formula, $R_1$ can be either a hydrogen or a methyl group, corresponding to an acrylamide or a methacrylamide respectively. $R_2$ and $R_3$ are independently hydrogen or hydrocarbyl groups, provided that the total number of carbons in $R_2$ and $R_3$ is in the range of 2 to 36 carbon atoms. Accordingly, when $R_2$ is a methyl group then $R_3$ must be an alkyl group rather than a hydrogen. It is preferred that the total number of carbon atoms in $R_2$ and $R_3$ be in the range of 4 to 36 carbon atoms, or 4 to 24 carbon atoms, or 4 to 12, or 4 to 8 carbon atoms. Other preferred ranges for the total number of carbon atoms in $R_2$ and $R_3$ are 8 to 36 carbon atoms, or 8 to 24 carbon atoms, or 8 to 12 carbon atoms. Preferred hydrophobic monomers include N-t-butylacrylamide and N-t-octylacrylamide.

The hydrophobic monomer can also be an acrylate or methacrylate ester of the formula:

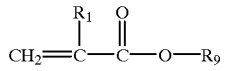

where $R_1$ is a hydrogen or a methyl group and $R_9$ is a hydrocarbyl group or an alkyl-terminated polyether group, in either case preferably containing up to 22 carbon atoms. It is preferred that $R_9$, particularly when it is a hydrocarbyl group, contain between 2–18 carbon atoms, 4 to 18 carbon atoms, 4 to 12, 4 to 8 carbon atoms, 8 to 20 carbon atoms, 8 to 16 carbon atoms, or 8 to 12 carbon atoms.

Hydrophilic Monomers

The hydrophilic monomers usable in the present invention are ethylenic monomers containing a sulfonic acid or, when in the salt form, a sulfonate group. These materials are referred to herein as "sulfonate monomers," without indicating, however, that they are necessarily in the salt form. Various types of sulfonate monomers have been found to be useful in the present invention. One class of hydrophilic monomers are the substituted acrylamides containing a sulfonic acid or sulfonate group, represented by the formula:

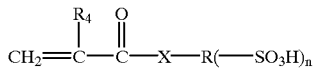

and salts thereof, wherein X is O or NY, where Y is hydrogen, a hydrocarbyl group of 1 to 18 carbon atoms or —R(—$SO_3H$)$_n$, $R_4$ is a hydrogen or a methyl group, each R is independently an aliphatic or aromatic hydrocarbylene group containing 2 to 18 carbon atoms, and each n is independently 1 or 2. In this formula, R acts as a bridge between the nitrogen portion of the acrylamido group and the sulfonate group or groups. The R group can be branched as in the molecule 2-acrylamido-2-methylpropane sulfonic acid, which, in its salt form, is represented by the following formula:

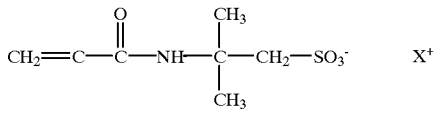

The R group can also include phenyl groups, alkyl substituted phenyl groups and cycloaliphatic groups. In another embodiment, the sulfonate monomer can be a substituted acrylamide containing two sulfonate groups, represented, in its salt from, by the following structure:

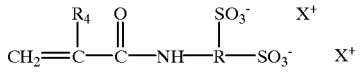

The sulfonate groups can be attached to the same or different carbon atoms.

As yet another alternative, the Y in the structure NY can be a second R(—$SO_3H$)$_n$ group or salt of such a group.

In addition to 2-acrylamido-2-methylpropane sulfonic acid and its salts, this class of materials includes 2-sulfoethylacrylate and -methacrylate salts and acid and 3-sulfopropylacrylate and -methacrylate salts and acids.

Another type of hydrophilic monomer includes styrenic sulfonic acids and salts thereof, which terms include styrene sulfonic acids and styrene sulfonates as well as substituted styrene sulfonic acids and substituted styrene sulfonates. Such materials are illustrated by the following formula:

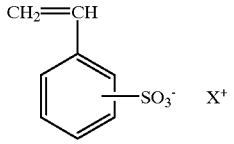

In all of the above structures, the $X^+$ is a cation which is preferably selected from the group consisting of alkali metal cations, alkaline earth cations, cations of the transition metals—Sc, Ti, V, Cr, Mn, Fe, Co, Ni, Cu, Zn, and ammonium ions. These ammonium ions generally have the formula:

$$R_5R_6R_7R_8N^+$$

where $R_5$, $R_6$, $R_7$, and $R_8$ preferably are independently hydrogen or hydrocarbyl groups. The term "ammonium" ion or salt, as used herein, is intended in a generic sense to include ammonium ions or salts in the strict sense, where $R_5$, $R_6$, $R_7$, and $R_8$ are each hydrogen, as well as amine ions or salts, where up to three of the R groups are hydrocarbyl groups, and quaternary ammonium ions or salts, where each of the R groups is a hydrocarbyl group. It is preferred that the total number of carbon atoms in an ammonium cation preferably does not exceed 21 carbon atoms.

A preferred hydrophilic monomer is the sodium salt of 2-acrylamido-2-methylpropanesulfonic acid. A preferred combination of hydrophobic and hydrophlic monomers is the combination of t-butylacrylamide and sodium 2-acrylamido-2-methylpropanesulfonic acid, preferably in an 80:20 mole ratio.

Branching Monomers

A third component of the present copolymer is at least one ethylenically unsaturated branching monomer. By "ethylenically unsaturated" is meant that a monomer contains at least one C=C double bond, and preferably a radically-polymerizable C=C double bond, so that the monomer can be introduced into a copolymer as another monomer. The term "branching monomer" indicates that the monomer is used to introduce a site of branching into the polymer. A branching monomer will normally contain a plurality of such double bonds, and preferably two of such bonds.

The branching monomer can be generally represented by the formula $Z_nR_{11}$. In this formula, $R_{11}$ is a hydrocarbylene group or a substituted hydrocarbylene group, or, alternatively, a plurality of hydrocarbylene groups linked by one or more linking heteroatoms (including, therefore, ethers, polyethers, and polyamine groups). The R group will have a valence of n, where n is greater than one, preferably 2, 3, or 4, and normally 2. In the same formula, each Z is independently a group containing at least one ethylenic unsaturation, preferably such groups as

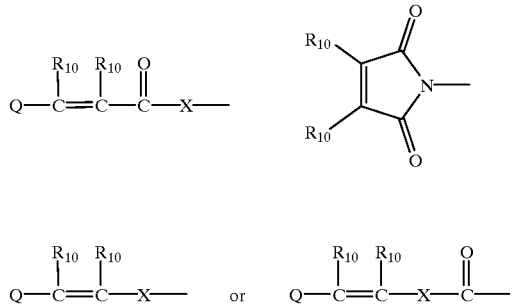

In these structures, each X is independently O or NH. When X is O, the corresponding structures are esters or ethers. When X is NH, the corresponding structures are amides or amines. Each $R_{10}$ in these structures is independently hydrogen or an alkyl group of 1 to 4 carbon atoms, and each Q is independently hydrogen, an alkyl group of 1 to 4 carbon atoms, an aromatic group, an acid group, an ester group, or an amide group.

In preferred embodiments, R is an alkylene group and Z is

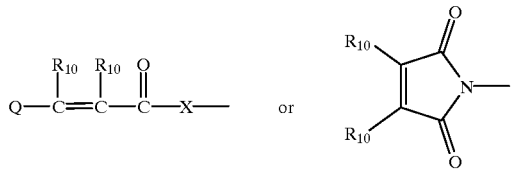

where X is NH, Q is hydrogen or an alkyl group of 1 to 4 carbon atoms, preferably hydrogen, and each $R_{10}$ is preferably hydrogen. That is, preferred branching monomers are unsaturated N,N-alkylenebisamides or -imides. A highly preferred alkylene group R is methylene; a highly preferred branching monomer, accordingly, is N,N'-methylene bisacrylamide.

Other suitable branching monomers include polyol acrylates or methacrylates, including ethylene glycol diacrylate, ethylene glycol dimethacrylate, trimethylolpropane triacrylate, trimethylolpropane trimethacrylate, polyethylene glycol (n=4–20) bisacrylate or -bismethacrylate, bis-(2-acryloyloxyethyl)-dialkylammonium salts (such as halides), and bisacrylamidoalkanesulfonic acids and salts thereof. Other materials which can be used include the corresponding esters of glycerol, pentaerythirtol, inositol and sugars such as sucrose (e.g., sucrose diacrylate). Difunctional materials are normally preferred.

Alternatively, the Z groups in the formula $Z_nR_{11}$ need not contain the carbonyl functionality shown above. Thus a material such as divinyl benzene and homologues thereof can be used as the branching monomer. Other such materials include di-isopropenylbenzene and bis-allyl-dimethylammonium salts (such as halides).

This component is referred to as a branching monomer, and not a crosslinking monomer or crosslinker. The distinction lies more in the effect the monomer has on the polymer in which it is incorporated than in any inherent feature of the monomer itself. That is, the monomer in question is to be incorporated into the polymer in an amount and under conditions which do not cause substantial crosslinking of the polymer. Crosslinking of the polymer is undesirable in the compositions of the present invention because it can lead to gelation, polymer insolubility or coagulation, and diminution of antimisting performance. Accordingly, the polymers of the present invention are not substantially crosslinked. A crosslinked polymer is one in which there are multiple bonds or linkages between one chain and another, normally leading to dramatically increased molecular weight and insolubility. In a crosslinked polymer it is necessary to break several bonds or links, in the backbone or elsewhere, before any substantial change in physical properties such as hydrodynamic volume is observed. Rather, in the present invention the monomer is incorporated into the polymer in such a way that it serves as a branching monomer, and thereby provides reduced mist formation when the resulting metal working fluid is subjected to metal-working conditions.

The amount of the branching monomer is normally limited to 1 mole per 100 to 10,000 moles of the hydrophobic and hydrophilic monomers described above. Preferably the ratio is 1:150 to 1:2000, and more preferably 1:200 to 1:1000, on a molar basis. Particular good results are observed at mole ratios of 1:400 to 1:2500. These ratios can be readily recalculated on a weight basis given the molecular weight of the monomers in question. For typical materials, these correspond approximately to 1:98 to 1:9800, preferably 1:148 to 1:1970, more preferably 1:197 to 1:980 and particularly 1:392 to 1:2450 by weight, respectively.

Formation of the Copolymer

The copolymer is generally produced by free radical polymerization. The polymerization can be done by well-known free radical methods. The general properties of acrylamide polymers, as well as their methods of preparation are discussed in *The Encyclopedia of Polymer Science and Engineering,* Volume 1, John Wiley & Sons, 1985 (pp 169–211). The Encyclopedia discusses techniques useful in forming acrylic ester polymers (pp 265–273). The polymerization may be conducted in solution, and by various suspension or emulsion methods. In solution polymerization, a solvent is selected which allows both the hydrophilic and hydrophobic monomers to be maintained in solution. Mixtures of water, acetic acid, various molecular weight alcohols such as, methanol, ethanol and butyl alcohol, as well as polar solvents such as acetone, acetic acid, tetrahydrofuran, dimethyl sulfoxide, dioxane, dimethyl formamide and N-methylpyrrolidinone. A wide variety of free radical sources may be used as initiators including persulfates, redox couples, azo compounds and the like. In particular, emulsion polymerization methods may be used to form polymers useful in the present invention. The preferred method of polymerization is solution polymerization which is conducted in much the same manner as the copolymerization of the binary copolymer, described in greater detail in copending U.S. application Ser. No. 08/644,600, filed May 13, 1996. Further illustrative details are provided in the following examples.

Polymer Preparation

EXAMPLE 1

A solution of 0.014 g (0.06 mmol) $Na_2S_2O_8$ initiator in 6 mL water is taken up in a 20 mL syringe. The syringe is placed on a pump which is set to deliver 0.07 mL/min. A 250 mL resin flask is charged with 0.012 g (0.08 mmol) N,N'-methylene bisacrylamide, 30 g (0.236 moles) of t-butylacrylamide, 13.5 g (0.054 moles) sodium salt of 2-acrylamido-2-methylpropanesulfonic acid and 50 g methanol. The reaction mixture is heated to 70° C. by a water bath. The reaction mixture is purged with nitrogen at 8.5 L/hr (0.3 std. $ft^3$/hr) and stirred at 250 r.p.m. using a 3-blade stainless steel stirrer. The initiator is added over a period of 1 hour, and midway through the addition, an additional 20 g of methanol is added. An additional 50 g methanol is added after addition of the initiator is complete. The reaction is stirred at 70° C. for a total of 4 hours. The reaction mixture is collected, the solvents removed, and the copolymerized product collected as a clear material. The amount of N,N'-methylene bisacrylamide comprises about 0.027 percent by weight of the polymer,

EXAMPLE 2

Example 1 is substantially repeated except that both the initiator and the N,N'-methylene bisacrylamide are added to the reaction mixture at a constant rate over the course of 1 hour.

EXAMPLES 3–6 and Reference Example 1

Example 1 is substantially repeated with only inconsequential variations except that the weight percent of N,N'-methylenebisacrylamide, as a percentage of the total monomers, is varied as indicated in the following table. Moreover, the amount of methanol included in the reaction mixture is varied as indicated:

| Ex. | N,N'-methylenebisacrylamide, wt. % | MeOH, g |
|---|---|---|
| Ref. 1 | 0 | —[a] |
| 1 | 0.027 | 120 |
| 3 | 0.045 | 170 |
| 4 | 0.13 | 160 |
| 5 | 0.23 | 240 |
| 6 | 0.27 | 150 |

[a]prepared on larger scale, using approximately 1000 g methanol

EXAMPLE 7

Into a 500 mL resin flask is charged 25.4 g (0.20 moles) t-butylacrylamide, 19.7g of a 58% solution of sodium salt of 2-acrylamido-2-methylpropanesulfonic acid (11.4 g active chemical, 0.05 moles), 0.03 g (0.002 moles) methylenebisacrylamide, 10 g water, and 51 g methanol. The flask is placed into a water bath and heated to 50° C., while stirring at 300 r.p.m. using a 3-blade stainless steel stirrer. Nitrogen is purged through the mixture at 8.5 L/hr (0.3 std. $ft^3$/hr).

In a separate beaker are mixed 0.75 g Triton™ 101 (surfactant from Union Carbide), 1.45 g Tween™ 85 (surfactant from Aldrich), 4.6 g sorbitan monooleate, and 66 g naphtha (solvent). The mixture thus prepared is added to the resin flask containing the monomers; an additional 34.5 g naphtha is also added.

A solution is prepared of 0.027 g $Na_2S_2O_8$ and 0.022 g $Na_2S_2O_5$ in water, for a total solution weight of 3.0 g. The solution is pumped into the reaction mixture using a syringe pump over the course of about ½ hour, during which time an additional 45 g methanol is also added. The reaction mixture is poured into 1 L naphtha and the naptha separated to yield a polymeric residue which is air dried for 2 hours and then oven dried at 80° C. for 16 hours, yielding 29.6 g of product.

Each of the polymers of Examples 1, 3 through 7, and Reference Example 1 are added at a level of 2,500 parts per million, by weight, to an emulsion of 3.5% by weight Trimsol™ naphthenic base stock in water.

The viscosity and efficiency of mist suppression in the above compositions are measured using the following techniques:

Measurements of solution viscosity are made by comparing the efflux time t required for a specified volume of polymer solution to flow through a capillary tube (Ostwald-Fenske capillary viscometer) with the corresponding efflux time $t_o$ of the solvent. From t, $t_o$ and the polymer concentration c, the inherent viscosity is derived based on the following equation $$\eta_{inh}=[ln(t/t_o)]/c$$

where the concentration c is expressed in grams per deciliter (g/dL). Methanol is used as solvent and measurements made at 30° C. and c=1.0 g/dL.

The ability of polymers to reduce mist formation in a liquid solution is evaluated by pumping the liquid to be tested at a rate of 32 mL/min through the center tube of a coaxial air blast atomizer. Air at high pressure (200 kPa [30 psig]) flows from the outer tube of the atomizer. The test liquid is atomized and the droplet spray is captured inside a 0.031 $m^3$ (1.1 $ft^3$) enclosure during an atomization period of 10 seconds. Once the atomization is complete, the flow of air and liquid is discontinued and the mist concentration within the enclosure is measured using a portable, real-time DatRAM™ aerosol monitor (from MIE Instruments Inc. of Bedford Mass.), which is a nephelometric monitor used to measure airborne particle concentration by sensing the amount of light scattered by the population of particles passing through a sampling volume. An unadditized soluble oil emulsion, which can easily be broken into aerosols produces the maximum concentration or particles is used as a baseline. The results are presented as concentration of particles in mg/$m^3$ The results are shown in the following table:

| Example | N,N'-methylene-bisacrylamide, wt % | inherent viscosity, dL/g | water solubility | mist, mg/$m^3$ (a) |
|---|---|---|---|---|
| Ref. 1 | 0 | 2.70 | yes | 7.70 |
| 1 | 0.027 | 2.74 | yes | 7.40 |

-continued

| Example | N,N'-methylene-bisacrylamide, wt % | inherent viscosity, dL/g | water solubility | mist, mg/$m^3$ (a) |
|---|---|---|---|---|
| 3 | 0.045 | 3.09 | yes | 5.93 |
| 7 | 0.08 | 2.78 | yes | (not determined) |
| 4 | 0.13 | 2.97 | yes | 4.64 |
| 5 | 0.23 | 2.73 | yes | 3.34 |
| 6 | 0.27 | n.a. | gel | n.a. |

(a) Mist concentrations from composition without any polymer additive is 8.02 and 7.58 mg/$m^3$ (duplicate runs). Ambient mist concentration averages 0.07 mg/$m^3$.
n.a.: not applicable Compositions The metal working fluids of the present invention include aqueous based, oil-free compositions. In their simplest form, these compositions include water, and the antimisting polymer. It is desirable to include the polymer at a level which is effective to suppress mist. However, even with recovery of used metal working fluids some is lost in use and the antimisting polymer is an expense. Accordingly, it is also desirable to use the antimisting polymers at the lower levels of their effective concentration range. Many factors affect the level of polymer required to achieve an antimisting effect. The shape of the tool and the work piece, the shear level in the particular application, and the rate of movement of the workpiece all influence the amount of mist suppression required. The antimisting polymer is typically used in a concentration range of 0.02 weight percent to 10 weight percent, preferably 0.05 to 2 weight percent, and more preferably 0.1 to 0.5 weight percent, based upon the total weight of the composition. A mixture of the antimisting polymers may also be used to prepare the compositions.

In addition to the antimisting polymer, the aqueous metal working fluids may contain additives to improve the properties of the composition. These additives include anti-foam agents, metal deactivators, and corrosion inhibitors, antimicrobial, anticorrosion, extreme pressure, antiwear, antifriction, and antirust agents. Such materials are well known to those skilled in the art.

The metal working fluids of the present invention may also be oil-in-water emulsions. The emulsion compositions contain the same types and amounts of antimisting polymers as the purely aqueous compositions discussed above. The compositions may also contain the property improving additives which have been used in the purely aqueous fluids noted above.

The oils used in the emulsion compositions may include petroleum oils, such as oils of lubricating viscosity, crude oils, diesel oils, mineral seal oils, kerosenes, fuel oils, white oils, and aromatic oils. Liquid oils include natural lubricating oils, such as animal oils, vegetable oils, mineral lubricating oils, solvent or acid treated mineral oils, oils derived from coal or shale, and synthetic oils. Synthetic oils include hydrocarbon oils and halo-substituted hydrocarbon oils such as polymerized and interpolymerized olefins, for example polybutylenes, polypropylenes, propylene-isobutylene copolymers, chlorinated polybutylenes, poly(1-hexenes), poly(1-octenes), poly(1-decenes); alkyl benzenes, such as dodecylbenzenes, tetradecylbenzenes, dinonylbenzenes, di-(2-ethylhexyl)benzenes; polyphenyls such as biphenyls, terphenyls, and alkylated polyphenyls; and alkylated diphenyl ethers and alkylated diphenyl sulfides and derivatives, analogs and homologs thereof.

Alkylene oxide polymers and derivatives thereof where terminal hydroxy groups have been modified by esterification, etherification etc. constitute another class of synthetic oils. These are exemplified by polyoxyalkylene polymers prepared by the polymerization of ethylene oxide or propylene oxide, the alkyl and aryl ethers of these polyoxyalkylene polymers such as methylpolyisopropylene glycol ethers, diphenyl and diethyl ethers of polyethylene glycol; and mono and polycarboxylic esters thereof, for example, the acetic esters, mixed $C_3$–$C_8$ aliphatic acid esters, $C_{12}$–$C_{22}$ fatty acid esters, and $C_{13}$ oxo diester of tetraethylene glycol. Simple aliphatic ethers may be used as synthetic oils, such as, dioctyl ether, didecyl ether, di(2-ethylhexyl) ether.

Another suitable class of synthetic oils comprises the esters of fatty acids such as ethyl oleate, lauryl hexanoate, and decyl palmitate. The esters of dicarboxylic acids such as phthalic acid, succinic acid, maleic acid, azelaic acid, sebacic acid, fumaric acid, adipic acid, linoleic acid dimer, malonic acid, alkyl malonic acids, alkenyl malonic acids with a variety of alcohols such as butyl alcohol, hexyl alcohol, dodecyl alcohol, 2-ethylhexyl alcohol, ethylene glycol, diethylene glycol monoethyl ether, propylene glycol are also useful. Specific examples of these esters include dibutyl adipate, di(2-ethylhexyl) sebacate, di-n-hexyl fumarate, dioctyl sebacate, diisoctyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Mixtures of various types of synthetic oils can also be used, provided that they have suitable compatibility properties.

The ratio of oil to water may vary from 1:5 to 1:200. Any oil-in-water emulsifier may be used to prepare the emulsions of the present invention. Emulsifiers may be single materials or may be mixtures of surfactants. Typical emulsifiers include alkali metal sulfonates and carboxylates, salts derived from the reaction product of carboxylic acylating agents with amines and hydroxylamines, polyols, polyether glycols, polyethers, and polyesters and the like. *The Kirk-Othmer Encyclopedia of Chemical Technology* (3rd. Edition V. 8 pp. 900–930) provides a good discussion of emulsions and provides a list of emulsifiers useful in preparation of oil-in-water emulsions.

Other Ingredients

A typical metal working fluid would include other components such as anti-foam agents, metal deactivators, corrosion inhibitors, antimicrobial, extreme pressure, antiwear, antifriction, and antirust agents. Typical anti-friction agents include overbased sulfonates, sulfurized olefins, chlorinated paraffins and olefins, sulfurized ester olefins, amine terminated polyglycols, and sodium dioctyl phosphate salts. Useful anti-foam agents include: poly (alkylacrylates), and polymethylsiloxanes. Metal deactivators include materials such as tolyltriazoles. Corrosion inhibitors include carboxylic/boric acid diamine salts, carboxylic acid amine salts, alkanol amines, alkanol amine borates and the like.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. It is to be understood that the upper and lower amount, range, and ratio limits set forth herein may be independently combined. As used herein, the expression "consisting essentially of" permits the inclusion of substances which do not materially affect the basic and novel characteristics of the composition under consideration.

What is claimed is:

1. An aqueous metal working fluid comprising water and a mist suppressing copolymer formed by copolymerizing:

(A) at least one hydrophobic monomer selected from the group consisting of

A(I) alkyl substituted acrylamide compounds represented by the formula:

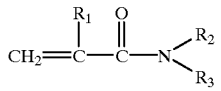

wherein $R_1$ is a hydrogen or a methyl group and $R_2$ and $R_3$ are independently hydrogen or hydrocarbyl groups, provided that the total number of carbon atoms in $R_2$ and $R_3$ combined is 2 to about 36;

(B) at least one hydrophilic monomer selected from the group consisting of

B(I) sulfonic acids represented by the formula:

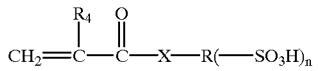

and salts thereof, wherein X is O or NY, where Y is hydrogen, a hydrocarbyl group of 1 to 18 carbon atoms or $—R(—SO_3H)_n$, $R_4$ is a hydrogen or a methyl group, each R is independently an aliphatic or aromatic hydrocarbylene group containing 2 to about 18 carbon atoms, and each n is independently 1 or 2; and B(II) styrenic sulfonic acids and salts thereof; and (C) at least one ethylenically unsaturated branching monomer represented by the formula

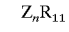

where $R_{11}$ is a hydrocarbylene group or a substituted hydrocarbylene group or a plurality of hydrocarbylene groups linked by one or more oxygen, sulfur, or nitrogen atoms, and each Z is independently

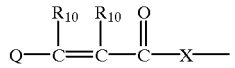

wherein each X is independently O or NH, each $R_{10}$ is independently hydrogen or an alkyl group of 1 to 4 carbon atoms, each Q is independently hydrogen, an alkyl group of 1 to 4 carbon atoms, an aromatic group, an acid group, an ester group, or an amide group; and n in component (C) is 2, 3, or 4;

wherein the salts of component (B) are selected from the group consisting of alkali metal salts, alkaline earth metal salts, salts of the metals Sc, Ti, V, Cr, Mn, Fe, Co, Ni, Cu and Zn, and ammonium salts;

further provided that the ratio of moles of A to B is about 95:5 to about 25:75; and where the amount of branching monomer C is sufficient to provide reduced mist formation when said aqueous metal working fluid is subjected to metal-working conditions but not so much as to cause substantial crosslinking of the polymer.

2. The metal working fluid of claim 1 wherein the total number of carbons atoms in $R_2$ and $R_3$ combined is 4 to 24 carbons.

3. The metal working fluid of claim 2 wherein the total number of carbons atoms in $R_2$ and $R_3$ combined is 4 to 8 carbons.

4. The metal working fluid of claim 2 wherein the total number of carbons atoms in $R_2$ and $R_3$ combined is 8 to 12 carbons.

5. The metal working fluid of claim 1 wherein the hydrophobic monomer is N-t-butylacrylamide.

6. The metal working fluid of claim 1 wherein the hydrophobic monomer is N-t-octylacrylamide.

7. The metal working fluid of claim 1 wherein the hydrophilic monomer is B(I).

8. The metal working fluid claim 7 wherein R contains 4 to 8 carbon atoms.

9. The metal working fluid of claim 7 where X is NH and n in component (B) is 1.

10. The metal working fluid of claim 1 wherein the hydrophilic monomer is 2-acrylamido-2-methylpropane sulfonic acid sodium salt.

11. The metal working fluid of claim 1 wherein the hydrophilic monomer is 2-acrylamido-2-methylpropane sulfonic acid sodium salt and the hydrophobic monomer is t-butylacrylamide.

12. The metal working composition of claim 1 wherein n in component (C) is 2, R is an alkylene group, and Z is

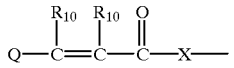

where X is NH and Q is hydrogen or an alkyl group of 1 to 4 carbon atoms.

13. The metal working composition of claim 12 wherein the branching monomer is N,N'-methylene bisacrylamide.

14. The metal working composition of claim 1 wherein the ratio of moles of C to the moles of A and B combined is about 1:100 to about 1:10,000.

15. The metal working composition of claim 1 wherein the ratio of moles of C to the moles of A and B combines is about 1:400 to about 1:2,500.

16. The metal working composition of claim 1 wherein the aqueous composition further comprises an oil and an emulsifier, wherein the aqueous composition is an oil-in-water emulsion.

17. A method for lubricating a metal workpiece in a cutting operation, comprising supplying to said workpiece the composition of claim 1.

18. The method of claim 7 wherein the composition further comprises an oil and an emulsifier, wherein the fluid is an oil-in-water emulsion.

19. The aqueous metal working fluid of claim 1 wherein the ethylenically unsaturated branching monomer (C) is a monomer which contains a plurality of polymerizable carbon—carbon double bonds.

* * * * *